US008733578B2

(12) United States Patent
Michaels

(10) Patent No.: US 8,733,578 B2
(45) Date of Patent: May 27, 2014

(54) DUAL-CHAMBERED SHOT GLASS

(71) Applicant: Paul Michaels, Houston, TX (US)

(72) Inventor: Paul Michaels, Houston, TX (US)

( * ) Notice: Subject to any disclaimer, the term of this patent is extended or adjusted under 35 U.S.C. 154(b) by 0 days.

(21) Appl. No.: 13/668,666

(22) Filed: Nov. 5, 2012

(65) Prior Publication Data

US 2013/0134169 A1 May 30, 2013

Related U.S. Application Data

(60) Provisional application No. 61/565,265, filed on Nov. 30, 2011.

(51) Int. Cl.

| | |
|---|---|
| ***B65D 57/00*** | (2006.01) |
| ***B65D 85/72*** | (2006.01) |
| ***B65D 25/04*** | (2006.01) |
| ***A47G 19/22*** | (2006.01) |

(52) U.S. Cl.

USPC ..... 220/531; 220/501; 220/505; 220/810; 220/825; 220/507; 220/719; 215/6; 206/219; 206/221; 222/145.4; 222/145.5; 221/133

(58) Field of Classification Search

USPC ..... 220/531, 501, 568, 578, 505, 810, 825, 220/507, 719, 711–715, 521; 215/6; 206/219, 211; 222/145.4, 145.5, 145.1; 221/133; 190/109, 111

See application file for complete search history.

(56) References Cited

U.S. PATENT DOCUMENTS

| | | | | | |
|---|---|---|---|---|---|
| 2,693,686 | A | * | 11/1954 | Pierce | 220/531 |
| 4,420,083 | A | * | 12/1983 | Baustin | 206/538 |
| 4,976,375 | A | * | 12/1990 | Quam | 220/534 |
| 5,031,793 | A | * | 7/1991 | Chen et al. | 220/495.07 |
| 5,375,734 | A | * | 12/1994 | Tiramani | 220/523 |
| 7,165,697 | B1 | | 1/2007 | Checkalski | |
| 7,243,812 | B2 | | 7/2007 | Mansfield | |
| 2008/0054002 | A1 | | 3/2008 | Moran | |

* cited by examiner

*Primary Examiner* — Fenn Mathew
*Assistant Examiner* — Jennifer Castriotta
(74) *Attorney, Agent, or Firm* — Daniel Boudwin; Global Intellectual Property Agency LLC

(57) ABSTRACT

A dual-chambered beverage container in the form of a shot glass. The interior of the glass is bisected via a hinged divider flap, creating two separate chambers within the glass. The upper chamber holds a first beverage, preferably a shot of hard liquor, while the bottom chamber holds a volume of a second beverage, such as soda or juice. When the shot glass is in a resting position, the divider flap is closed, segregating the beverages in their respective chambers. A user begins to drink the first beverage, the hinged diver flap will slowly swing open, allowing the second beverage to flow out of the bottom chamber, through the upper chamber, and into the user's mouth. Thus the user experiences the taste of the shot of hard liquor only briefly before consuming the chaser beverage.

3 Claims, 3 Drawing Sheets

DUAL-CHAMBERED SHOT GLASS

CROSS REFERENCE TO RELATED APPLICATION

This application claims the benefit of U.S. Provisional Application No. 61/565,265 filed on Nov. 30, 2011, entitled "ContraShot." This provisional patent application is incorporated here by reference in its entirety to provide continuity of disclosure.

BACKGROUND OF THE INVENTION

1. Field of the Invention

The present invention relates to a multi-chambered beverage container. More specifically, it relates to a shot glass having two chambers separated by a hinged divider. A first beverage can be poured in the bottom chamber, and a second beverage poured into the upper chamber. The beverage container will be appreciated by bar patrons who enjoy drinking a "chaser" beverage after ingesting a shot of hard liquor.

Shots of liquor are commonly consumed by bar patrons who are interested in trying new liquors or consuming a higher proof drink. Hard liquors often have a harsh taste that leaves a burning sensation in the mouth of a user after the beverage is consumed. Some people prefer to have a mild drink (chaser) immediately after downing a shot of hard liquor in order to make the shot more palatable. Drinks such as soda, fruit or vegetable juice, or even water can be used as chasers to quell some of the burning sensation experienced by shot-drinkers. Aside from the possible harsh taste, some hard liquor is mildly caustic to the soft tissues of the human mouth and throat. These liquors should be washed down promptly after a user tastes the drink, to avoid extended exposure to the alcohol.

Drinking a chaser after a shot of hard liquor generally involves the purchase of both the liquor and a full-sized beverage. In this way, the bar generates revenue off both the liquor and the beverage. Heightened costs associated with the purchase of unwanted full-size beverages may deter some bar patrons from purchasing shots of liquor or trying new liquors, for fear that they will not like the taste and will have nothing to wash the liquor down with. A means of providing bar patrons with liquor shots and chasers is needed that is also cost effective to bar owners and managers. The present invention solves this problem by providing a dual-chambered shot glass that can hold both a shot of hard liquor and a shot of chaser beverage, thereby negating the need to dirty two glasses or pay full price for a full-sized chaser beverage.

2. Description of the Prior Art

The present invention is a dual-chambered beverage container for holding multiple types of drinks at the same time. A bottom chamber and an upper chamber of the beverage container are separated by a hinged flap that remains closed while the container is in an upstanding, vertical position. As a user drinks the first beverage and tilts the container downward, the flap swings open, allowing the second beverage to flow into the user's mouth. The prior art discloses several dual-chambered devices but none of them have a movable divider between chambers of the beverage container.

A dual-chambered beverage container is disclosed by Moran, U.S. Patent Application Publication No. 2008/0054002. The beverage container is a shot glass having two vertical chambers divided down the middle of the glass interior by a wall. The wall is static and inflexible, separating the beverage container into two distinct interior regions. A first beverage is poured in one chamber and a second beverage is poured in the other chamber. When a user drinks from the beverage container the drinks immediately comingle in the user's mouth. Conversely, the present invention provides two stacked beverage chambers so that the second beverage is not consumed by the user until after the first beverage, i.e. as a chaser.

A similar problem exists with dual-chambered beverage containers that comprise a chamber within a chamber. Checkalski, U.S. Pat. No. 7,165,697 discloses a shot glass having a first chamber defined by the beverage container perimeter. A second chamber is disposed within the first chamber, and comprises a diagonally oriented cylindrical chamber. One beverage is placed within the first chamber and a second beverage is placed within the diagonal second chamber. Because the beverage in the second chamber is tilted at an angle, the user will begin to consume one beverage just prior to consuming the other beverage. This design improves upon the vertical bi-chambered glass of Moran, but does not solve the problem of providing a user with one beverage after the other.

Similarly, Mansfield, U.S. Pat. No. 7,243,812 includes a beverage container having a first chamber within a second chamber. The container is comprised of an outer ring chamber and an inner chamber disposed in the center of the outer ring chamber. The inner chamber is shallower than the outer ring chamber and only holds a small amount of liquid. Like the aforementioned devices, Mansfield does not reduce the mixing of two beverages during consumption by a user.

None of the prior art devices includes two stacked chambers, nor do they disclose a hinged flap divider. The divider of the present invention of invention separates two chambers to prevent mingling of contained beverages. The beverages remain separated until after a user consumes the first beverage. The invention substantially diverges in design elements from the prior art and consequently it is clear that there is a need in the art for an improvement to existing multi-chambered beverage container devices. In this regard the instant invention substantially fulfills these needs.

SUMMARY OF THE INVENTION

In view of the foregoing disadvantages inherent in the known types of multi-chambered beverage containers now present in the prior art, the present invention provides a new hinged divider flap wherein the same can be utilized for providing convenience for the user when drinking a shot of hard liquor with a chaser.

The dual-chambered beverage container is a shot glass having two separate beverage holding regions. The shot glass may be cylindrical or rectangular or have any other general geometric shape. The interior chambers may be similarly shaped. There are two chambers, a bottom chamber and an upper chamber, separated by a hinged divider. It is hinged to swing upward so that the weight of a beverage being poured into the upper chamber will keep the divider closed, separating the contents of the two chambers. When the shot glass is tilted to pour the first beverage into a user's mouth, the loss of force against the divider allows it to swing open. The second beverage will then flow into the user's mouth, creating a chaser for the first beverage.

The shot glass is an easy to use beverage container that prevents two beverages from mingling prior to ingestion by a user. Because the two drinks are served in the same glass, bartenders will not have to dirty two glasses to serve the drink. This makes the invention more time and cost efficient for bar staff. Additionally, the size of the chaser is equivalent tot hat of the shot of liquor and can be priced accordingly by a bar manager. Patrons will appreciate saving money when they do not have to purchase full-sized beverages just to enjoy a small sip with a shot of hard liquor. In this way, the present invention provides a convenient and cost effective means for serving liquor and chasers to bar patrons.

It is therefore an object of the present invention to provide a new and improved multi-chambered beverage container device that has all of the advantages of the prior art and none of the disadvantages.

It is therefore an object of the present invention to provide a means for serving bar patrons a shot of hard liquor and a chaser beverage in the same container.

Another object of the present invention is to provide a dual-chambered beverage container that separates two beverages prior to and during consumption.

Yet another object of the present invention is to provide a means for bar patrons to enjoy a shot of hard liquor and a chaser beverage at the same time.

A further object of the present invention is to provide a means for bar patrons to enjoy a shot of hard liquor and a chaser without having to purchase a full size chaser beverage.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 2:
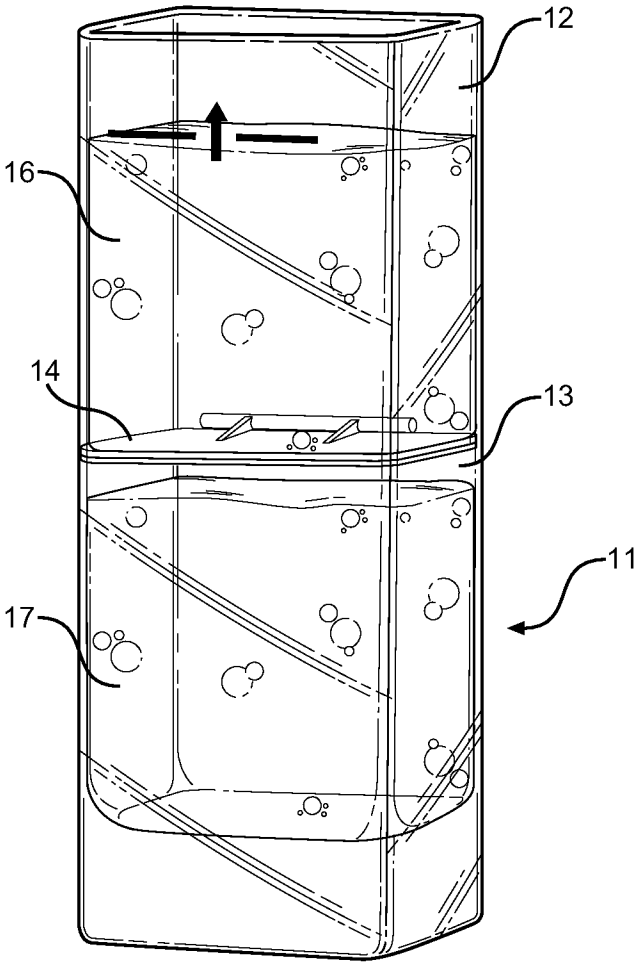
FIG. 2 shows a perspective view of the dual-chambered shot glass when both chambers of the glass are filled with a beverage.

Reference is made herein to the attached drawings. Like reference numerals are used throughout the drawings to depict like or similar elements of the dual-chambered beverage container. For the purposes of presenting a brief and clear description of the present invention, the preferred embodiment will be discussed as used for providing a user with a means for drinking a shot of hard liquor at the same time as a chaser beverage. The figures are intended for representative purposes only and should not be considered to be limiting in any respect.

Figure 1:
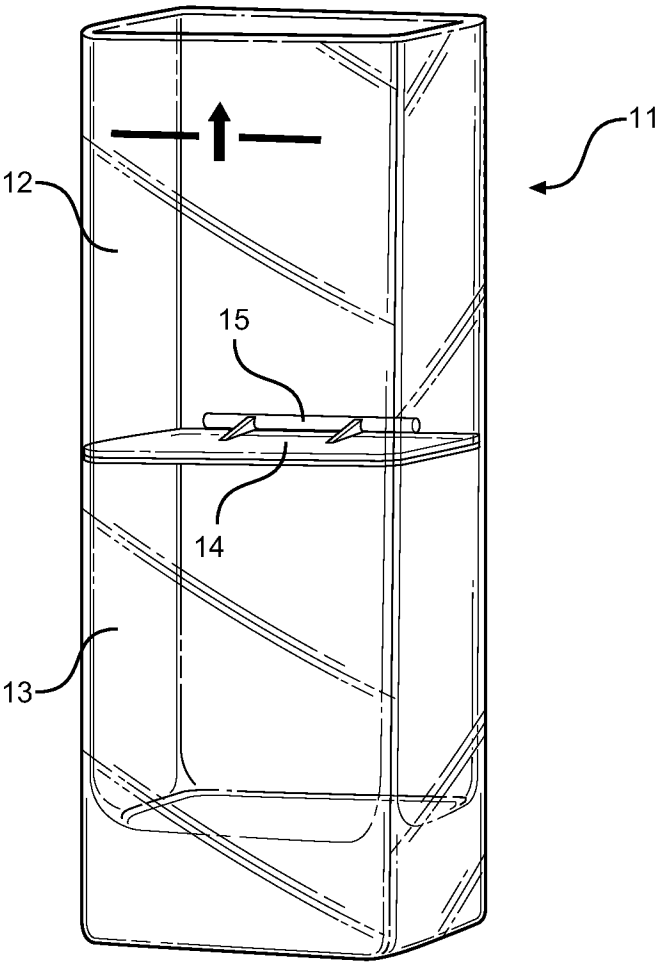
FIG. 1 shows a perspective view of the dual-chambered shot glass when both chambers are empty.

Referring now to FIG. 1, there is shown a dual-chambered beverage container in the form of a shot glass. The shot glass 11 has four walls and a bottom, defining an interior space. A unique feature of the shot glass is the bi-section of the interior space via a divider flap 14 that is hingedly secured to one interior wall. This bisection separates the interior space into an upper chamber 12 and a bottom chamber 13. When the divider flap lies down against the wall of the glass, as illustrated herein, there are two distinct chambers, but when the hinge 15 and divider flap swing open the bi-section is removed and there is once again a single interior space.

Referring now to FIG. 2, there is shown a dual-chambered shot glass filled with two beverages. The shot glass 11 has an upper chamber 12 and a bottom chamber 13 that are filled with beverages. A first beverage 16, preferably hard liquor such as rum, vodka, gin, or whiskey, is retained in the upper chamber. This will be the first beverage the user consumes, as it is closest to the open end of the shot glass. A measuring mark may be displayed on the outside of the glass to assist bartenders with accurate measurement of a 1 oz. shot of liquor. In the bottom chamber is a second beverage 17 such as soda, juice, or water. This is the "chaser" beverage and will be consumed by the user after the first beverage because the hinged divider flap 14 prevents the two beverages from comingling prior to opening of the flap.

To ensure that the divider flap is a proper barrier between the two chambers, there may be a small lip disposed around the interior of the glass, just below the divider flap. This lip may be integrated into the glass and made of the same material or alternatively may be a rubber or plastic ring that is secured to the interior walls. When the glass is in a resting positioning, the divider flap lies flat on the lip, reducing the likelihood that the top beverage will leak into the bottom chamber Additionally, the lip will reduce the propensity of the divider flap for getting stuck up against the interior walls of the glass, because without the lip, the divider flap would need to fit snuggly against the walls to prevent seepage of beverages.

Figure 3:
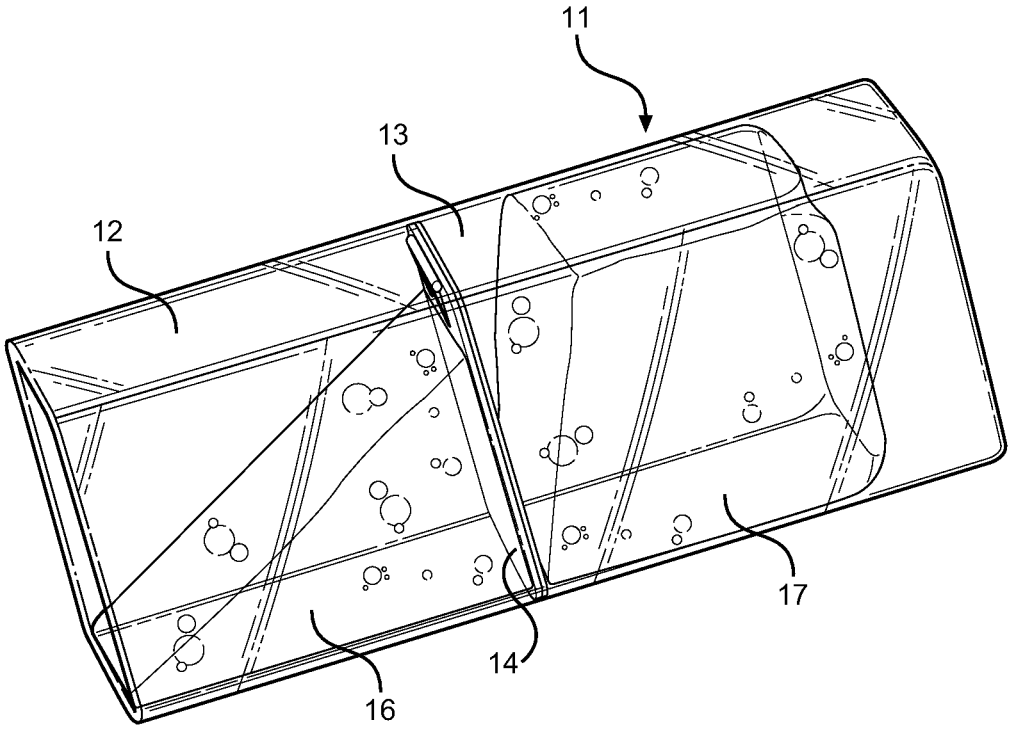
FIG. 3 shows a perspective view of the shot glass in use. A first beverage flows out the open end of the glass while the hinged divider holds the second beverage within the bottom chamber.
Figure 4:
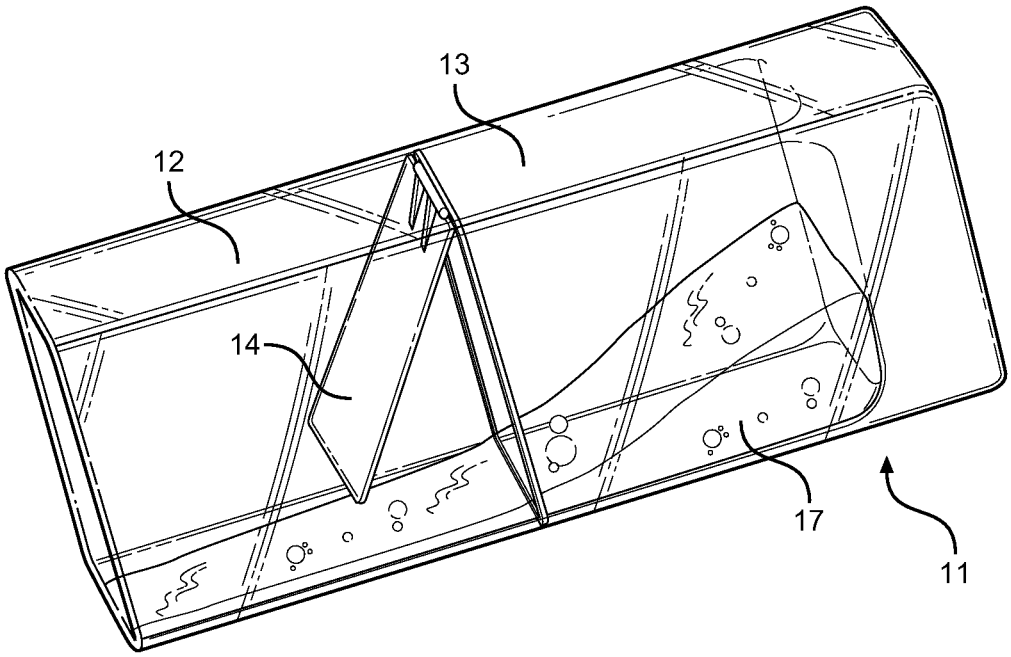
FIG. 4 shows a perspective view of the dual-chambered shot glass in use. The first beverage has been consumed and the hinged divider swings open to allow the second beverage to flow out the open end of the container.

The chambers of the present invention are aligned in a vertical stacked fashion to promote consumption of the first beverage prior to the second. When the open end of the shot glass 11 is tilted downward, as in FIG. 3, the first beverage 16 flows out of the upper chamber 12. A hinged divider flap 14 segregates the first beverage from a second beverage 17, which is stored within the bottom chamber 13 of the glass. The divider flap is held in place by the first beverage until it is consumed. As the volume of the first beverage depletes, the divider flap begins to swing open, as shown in FIG. 4. Separation of the divider flap from the walls of the shot glass produces an opening between the upper chamber 12 and the bottom chamber 13. The second beverage 17 flows out of the bottom chamber, through the upper chamber and out of the top end of the shot glass. In this way, the user drinks the first beverage, preferably a shot of hard liquor, and then the second beverage.

Figure 5:
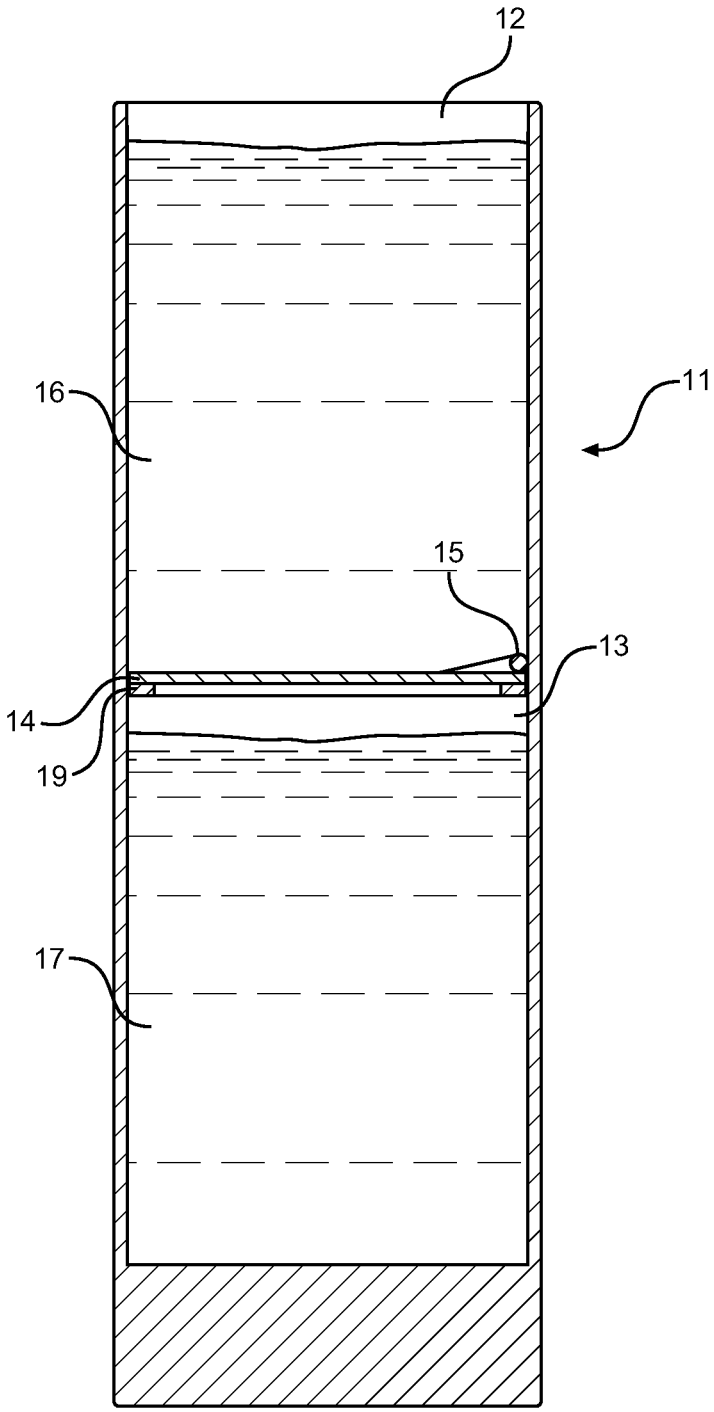
FIG. 5 shows a cross-sectional view of the dual-chambered shot glass.

A cross-section view of the dual-chambered beverage container is shown in FIG. 5. The shot glass 11 has an upper chamber 12 filled with a first liquid 16 and a bottom chamber 13 filled with a second liquid 17. These two chambers are created via a dividing flap 14 secured within the interior space of the shot glass. A hinge 15 permits the flap to swing open in an upward direction. When in a closed position, the flap rests on a thin lip 19 that extends around the walls of the interior space. This lip prevents the divider flap from swinging downward and helps create a seal between the flap and the glass so that the beverages do not comingle.

In use a bartender tilts the glass upside down to open the divider flap and then holds the shot glass at an angle, with the open end exposed. This helps keep the divider flap open during preparation of the drink. The bartender then pours a chaser beverage into the glass until the bottom chamber is mostly full. The shot glass can then be placed on a flat surface or rotated to a vertical position so that the divider flap closes. A straw, drink stirrer, or piece of silverware can be used to gently tap the divider flap down onto the lip, ensuring a seal between the divider and the glass. The bartender then pours hard liquor into the upper chamber of the shot glass, using the measuring mark to determine when a full shot (1 oz.) is in the glass. After the glass is filled, the bartender hands the drink to a patron. The patron then lifts the glass to his or her lips, tilts the open end of the glass into his mouth and drinks the first and then the second beverage.

The present invention is a dual-chambered shot glass that provides bar patrons with an easy and cost effective way of enjoying a shot of hard liquor with a chaser beverage. The glass may be rectangular, cylindrical, hexagonal or any other desired shape. It is important that the chambers of the glass be aligned in a vertical stack in order to promote consumption of the first beverage prior to the second. These chambers may be equally sized or may hold differing volumes of liquid depending on the needs of the bar and the specific intended use. For example a shot glass intended for use with vodka and Tabasco sauce may only include a small bottom department, because few people care to consume an entire shot of Tabasco sauce. Additionally, the glass may be constructed of plastic, glass, or metal, so long as the material is durable and easily cleanable.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dual-chambered beverage container, comprising:

a container having at least one wall, a closed bottom end and open top, defining an interior space;

a movable divider flap hingedly secured to an interior of a wall of said container, wherein said divider flap separates said container into an upper chamber and a bottom chamber;

wherein said movable divider flap is a solid piece;

a lip disposed around the entire circumference of the interior of said container and between said upper and bottom chambers to prevent a liquid from leaking into said bottom chamber from said upper chamber when said divider flap rests upon said lip.

2. The device of claim 1, wherein said chambers have equal volumes.

3. The device of claim 1, wherein a measuring mark is disposed along said beverage container in a position corresponding to a meniscus level of a 1 ounce volume of liquid within said upper chamber.

* * * * *